US006363997B1

(12) United States Patent
Urlau

(10) Patent No.: US 6,363,997 B1
(45) Date of Patent: Apr. 2, 2002

(54) METHOD AND DEVICE FOR CASTING METAL CLOSE TO FINAL DIMENSIONS

(75) Inventor: Ulrich Urlau, Moers (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/700,804

(22) PCT Filed: Mar. 19, 1999

(86) PCT No.: PCT/DE99/00891

§ 371 Date: Jan. 11, 2001

§ 102(e) Date: Jan. 11, 2001

(87) PCT Pub. No.: WO99/59750

PCT Pub. Date: Nov. 25, 1999

(30) Foreign Application Priority Data

May 19, 1998 (DE) ..... 198 23 440

(51) Int. Cl.[7] ..... B22D 11/18

(52) U.S. Cl. ..... 164/453; 164/483; 164/479; 164/155.4; 164/155.6; 164/447; 164/441; 164/429

(58) Field of Search ..... 164/453, 483, 164/479, 429, 155.4, 155.6, 417, 447, 448, 441

(56) References Cited

U.S. PATENT DOCUMENTS 4,993,477 A * 2/1991 Praeg ..... 164/453

6,192,973 B1 * 2/2001 Schwerdtfeger et al. .... 164/441

* cited by examiner

*Primary Examiner*—Nam Nguyen
*Assistant Examiner*—I.-H. Lin
(74) *Attorney, Agent, or Firm*—Cohen, Pontani, Lieberman & Pavane

(57) ABSTRACT

A method and a device for the casting of rectangular billets from metal, in particular from steel, close to final dimensions, and for the subsequent inline rolling out of the billet, with a material supply vessel, via the outlet nozzle of which the liquid metal is deposited onto the upper strand of a conveyor belt, on which it solidifies and is transferred to a roll stand for forming, characterized by the following steps:

a) before the start of casting
  aa) the point at which the liquid metal is deposited onto the conveyor belt is predetermined approximately,
  ab) the conveying speed of the conveyor belt is set as a function of the desired rolling thickness and rolling speed of the roll stand, b) during casting
  ba) the position of thorough solidification of the metal billet located on the conveyor belt is detected,
  bb) the temperature of the rolling stock is detected in the region of the roll stand, and
  bc) the position of thorough solidification and the temperature of the rolling stock are used as control variables for the current position of the point at which the liquid metal leaving the material supply vessel is deposited onto the conveyor belt.

20 Claims, 3 Drawing Sheets

41
46
47
48
57
92
91
58
93
W
56
S
52
51
31
45
11
44
62,63
54
61
66
67
M
M
55
13
33
32
23
34
53
43
21
16
14
22

METHOD AND DEVICE FOR CASTING METAL CLOSE TO FINAL DIMENSIONS

This application is A 371 of PCT/DE99/00891 filed Mar. 13, 1999.

BACKGROUND OF THE INVENTION

1. Field of the Invention

The invention relates to a method for the casting of rectangular billets from metal, in particular from steel, close to final dimensions and for the subsequent inline rolling out of the billet, with a material supply vessel, via the outlet nozzle of which the liquid metal is deposited onto the upper strand of a conveyor belt, on which it solidifies and is transferred to a roll stand for forming. The invention further relates to a corresponding device for carrying out the method.

2. Discussion of the Prior Art

Stahl und Eisen [Steel and Iron] 1986, page 65ff., discloses a method with a traveling mold for casting close to final dimensions, in which the steel is cast onto casting carriages moving horizontally. The casting carriages run on a rail, and at the end of the mold section the billet is transferred to a roller table, and the billet must have thoroughly solidified at the latest when it enters the first roll stand arranged downstream. This publication specifies the relationship between the casting speed and the effective mold length. There is no suggestion in this publication of changing the position of the material supply vessel during operation.

German reference DE 43 44 953 C2 discloses a method for casting a metal strip close to final dimensions on a belt-type casting device provided with a melt receiving vessel and with a conveyor belt, which lists method instructions and means for exerting influence on the spread of the metal melt on the conveyor belt. The arrangement of the casting vessel in relation to the conveyor belt cannot be changed in this case.

SUMMARY OF THE INVENTION

The object of the invention is to provide a method and a corresponding device in which simple design means ensure casting close to final dimensions and subsequent rolling of rectangular billets of high and uniform quality at any desired casting speed and with any desired billet thicknesses.

According to the invention, before the start of casting, the material supply vessel is set in a predeterminable position with respect to the longitudinal extent of the conveyor belt and therefore the point at which the liquid metal is deposited onto the conveyor belt is predetermined approximately. Furthermore, the conveying speed of the conveyor belt is set as a function of the desired rolling thickness and rolling speed of the roll stand. During operation, the position for thorough solidification and the temperature of the rolling stock are then used as control variables for the current position of the point at which the liquid material leaving the material supply vessel is deposited onto the conveyor belt.

The variable depositing of the melt onto the conveyor belt affords a simple and highly effective possibility for setting the mean temperature of the cast strip both at the end of the conveyor belt and at entry into the roll stand. In this case, the mean temperature comprises the average of the permissible temperature differences over the strip cross section of the cast strip.

The variable depositing point of the melt, specifically both approximate setting and the fine setting which is carried out during operation, makes it possible to set a special inlet temperature profile of the billet at entry into the rolling mill.

In addition to influence being exerted on the current position of the point at which the liquid metal leaving the material supply vessel is deposited onto the conveyor belt, further regulating subsystems are also advantageously used. Thus, it is proposed to detect the thickness of the material billet located on the conveyor belt and use said thickness for controlling the quantity flow of the liquid material leaving the material supply vessel. In a further advantageous procedure, the speed of the conveyor belt is detected and is used to control the quantity flow of the liquid material leaving the material supply vessel. Furthermore, the geodetic height of the metal located in the material supply vessel may be taken into account in the control of the quantity flow.

Moreover, in order to control the position of the material depositing point, it is proposed to take into account the discharge of heat from the metal billet located on the conveyor belt.

For carrying out the method, the material supply vessel has movement elements, by means of which it is capable of being moved horizontally, and at the same time coaxially to the major axis of the conveyor belt, in or opposite to the conveying direction of the billet. Furthermore, the material supply vessel is connected to an actuator which, for regulating purposes, is connected to a regulating means taking into account the thorough solidification of the billet and the temperature of the rolling stock and by means of which the position of the material supply vessel can be set as desired.

In an advantageous embodiment, the material supply vessel is equipped with wheels which run on rails. It is proposed, furthermore, to use sliding elements which match with a track.

In another advantageous embodiment, the movement elements are a thrust mechanism which is designed such that the mouth of the outlet nozzle of the material supply vessel can be guided at a constant distance from the upper strand of the conveyor belt over a defined region considered to be sufficient.

In another embodiment, piston/cylinder units are used, which are connected to a regulating means in such a way that, in the event of a horizontal movement of the material supply vessel, the mouth of the latter can be guided at a constant distance from the upper strand of the conveyor belt. In this case, the piston/cylinder units form the supports which are mounted at the corners of the material supply vessel.

A hydraulic piston/cylinder unit is proposed as an advantageous embodiment of an actuator for changing the horizontal position of the material supply vessel. In one embodiment, a piston/cylinder unit is provided, which is designed as a synchronous cylinder, one end of which is connected to the material supply vessel by a spacer rod.

In another advantageous embodiment, it is proposed that the position actuator be an electric drive which is connected to the material supply vessel by an endless belt.

It is proposed, furthermore, to arrange the position actuator and the material supply vessel on a stand and, in this case, to use the actuator for fine tuning and the stand, which has its own drive, for the approximate positioning of the material supply vessel.

Various forms of construction are proposed for the material supply vessel. In one embodiment, the material supply vessel is preceded by a ladle which is provided with a stopper rod or with a slide and which controls the inflow of the liquid metal. In another embodiment, the material supply vessel is designed as a vacuum vessel having a charging chamber, into which the melt is introduced.

In order to achieve reliably the desired material properties and the intended inlet temperature profile, in one embodiment of the invention a housing is provided which encases at least the free surfaces of the billet from the point at which the liquid metal is deposited onto the conveyor belt and during transport by the latter. This housing possesses a cover which is designed as a blind. This blind is connected at one end to the outlet nozzle of the material supply vessel and at the other end possesses a winding device. This housing is connected to a gas supply means, via which, in particular, inert gas is conveyed into the free space.

BRIEF DESCRIPTION OF THE DRAWINGS

An example of the invention is presented in the accompanying drawing in which.

DETAILED DESCRIPTION OF THE PREFERRED EMBODIMENTS

Figure 1:
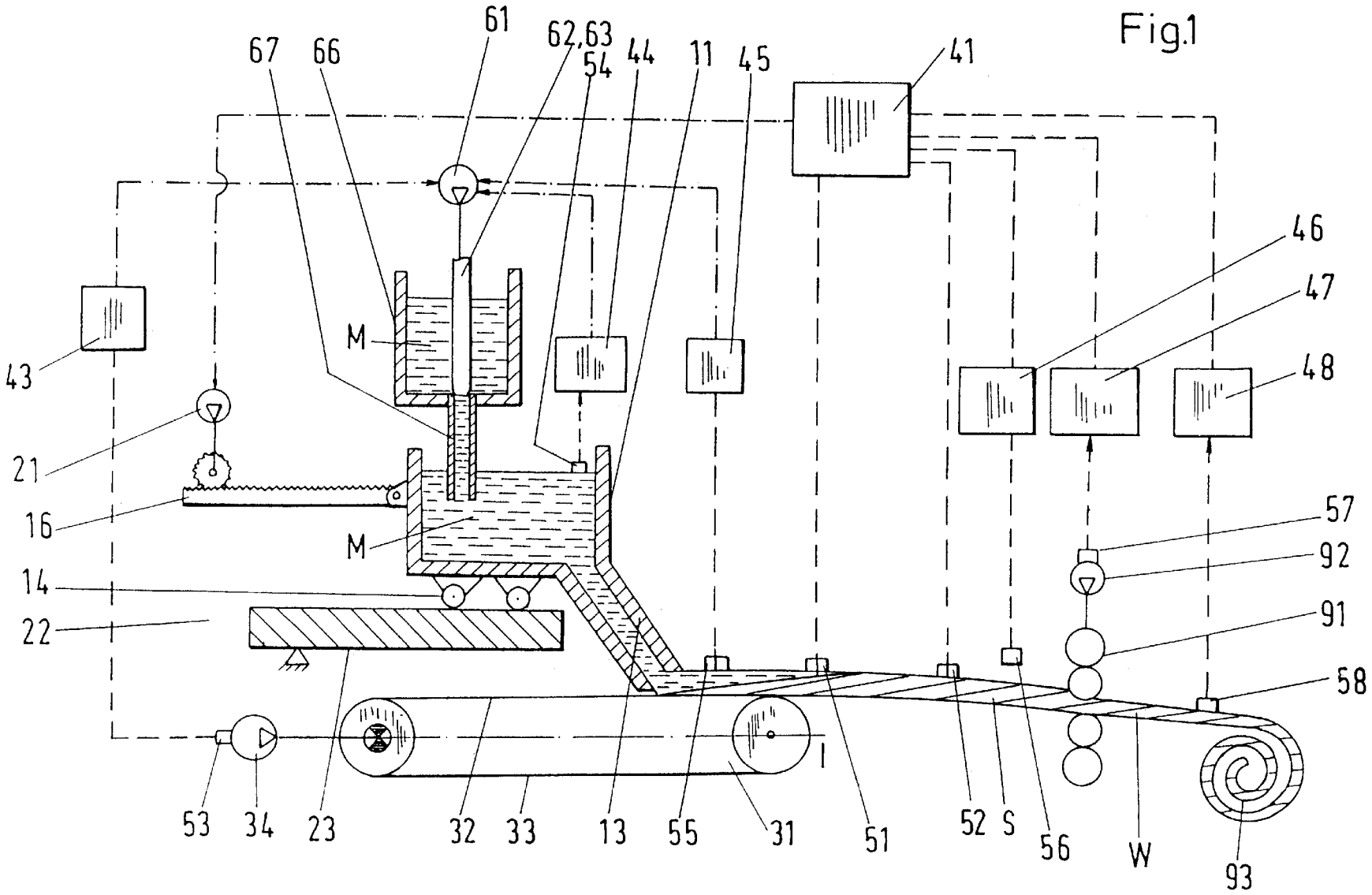
FIG. 1 shows a device for casting close to final dimensions, including the regulating means.

FIG. 1 shows a material supply vessel 11, via the outlet nozzle 13 of which liquid metal M is supplied to a conveyor belt 31. The material supply vessel 11 is capable of being moved in the direction of the major axis I of the conveyor belt 31 via movement elements 22, these being, in the present case, wheels 14 which run on a rail 23. In this case, the material supply vessel is moved horizontally in the direction of the major axis I of the conveyor belt 31 by an actuator 21 via a spacer rod 16.

In order to supply the liquid metal M into the material supply vessel 11, a ladle 66 is provided, which possesses a dip spout 67 capable of being closed at the head end by means of a stopper rod 63.

The conveyor belt 31, which possesses an upper strand 32 and a lower strand 33, is driven by a drive 34. On the upper strand 32, the liquid metal M solidifies to form the billet S and is supplied to a roll stand 91. This roll stand is driven by a roll drive 92 which rolls out the billet S to the desired thickness of the rolling stock W and finally winds it up in a winding means 93.

The device for the casting of rectangular billets from metal close to final dimensions is equipped with a series of measuring elements, specifically with a measuring element 51 for detecting the thorough solidification of the billet S and with a measuring element 52 for detecting the temperature of the rolling stock W.

A measuring element 53 for detecting the speed is provided on the drive 34 of the conveyor belt 31.

A measuring element 54 for detecting the geodetic height of the liquid metal M is arranged in the material supply vessel 11.

A measuring element 55 for detecting the thickness of the metal billet is arranged above the upper strand 32 of the conveyor belt 31 in the vicinity of the outlet nozzle 13 of the material supply vessel 11.

A measuring element 56 for detecting the discharge of heat from the billet S is provided in the vicinity of the roll stand 91 and upstream of the latter in the billet conveying direction.

A measuring element 58 for detecting the thickness of the rolling stock W is arranged downstream of the roll stand 91 in the conveying direction of the billet.

The measuring element 51 for detecting thorough solidification and the measuring element 52 for detecting the temperature of the rolling stock are connected to a regulating means 41 which is connected for control purposes to the actuator 21 for setting the position of the material supply vessel 11.

The measuring element 53 for detecting the speed of the conveyor belt is connected to a regulating means 43, the measuring element 54 for detecting the geodetic height is connected to a regulating means 44 and the measuring element 55 for detecting the thickness of the metal billet is connected to a regulating means 45, the regulating means 43–45 being connected to an element 61 for controlling the quantity of liquid metal M.

The measuring element 56 for detecting the heat discharge is connected to a regulating means 46, the measuring element 57 for detecting the speed of the roll stand is connected to a regulating means 47 and the measuring element 58 for detecting the thickness of the rolling stock is connected to a regulating means 48, the regulating means 46–48 being linked to the regulating means 41. At the same time, the (main) regulating means 41 relies essentially on the measurement values from the measuring elements 51–52 and, in addition, on those from the measuring elements 56–58.

Figure 2:
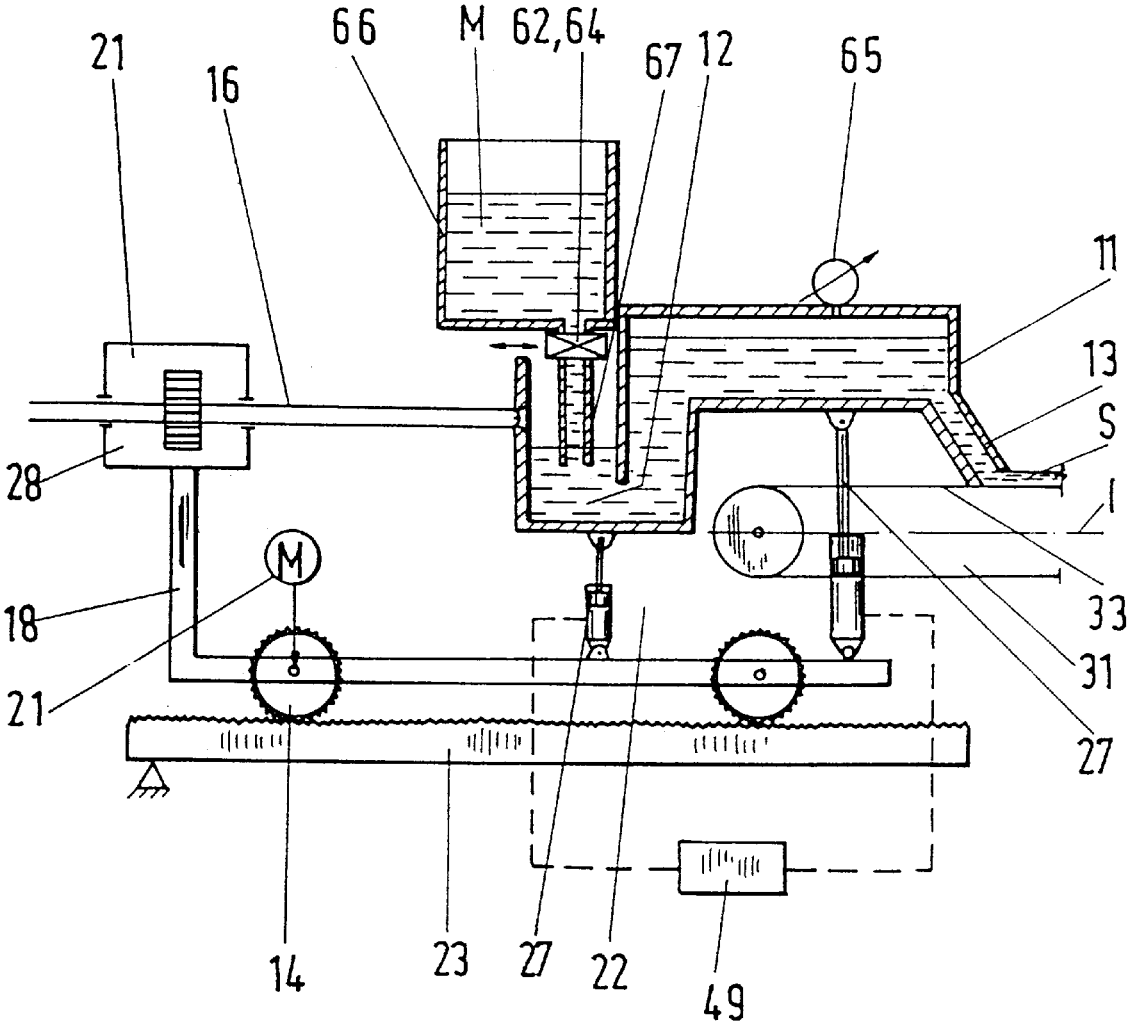
FIG. 2 shows the embodiment of the material supply vessel as a vacuum vessel.

FIG. 2 shows a material supply vessel 11 designed as a vacuum vessel which is connected to a vacuum device 65. This material supply vessel possesses a charging chamber 12, into which a dip spout 67 projects. The dip spout 67 is capable of being closed by means of a closing element 62 which is designed here as a slide 64. The dip spout 67 is arranged in the bottom of a ladle 66 in which liquid metal M is located.

The material supply vessel is supported on movement elements 22 which are designed here as piston/cylinder units 27. These piston/cylinder units 27, which are connected for regulating purposes to a regulating means 49, are capable of maintaining the outlet nozzle 13 at a constant distance from the upper strand 33 during a movement of the material supply vessel in the direction of the major axis I of the conveyor belt 31.

The material supply vessel 11 is connected via a spacer rod 16 to an actuator 21 which is designed here as a piston/cylinder unit 28.

The actuator 21 for fine tuning and the movement elements 22 are arranged, in the present case, on a stand 18 which is capable of being moved on a rail 23 via wheels 14. In order to set the position, in particular the approximate position, of the material supply vessel 11, at least one of the wheels 14 is connected to a further actuator 21.

Figure 3:
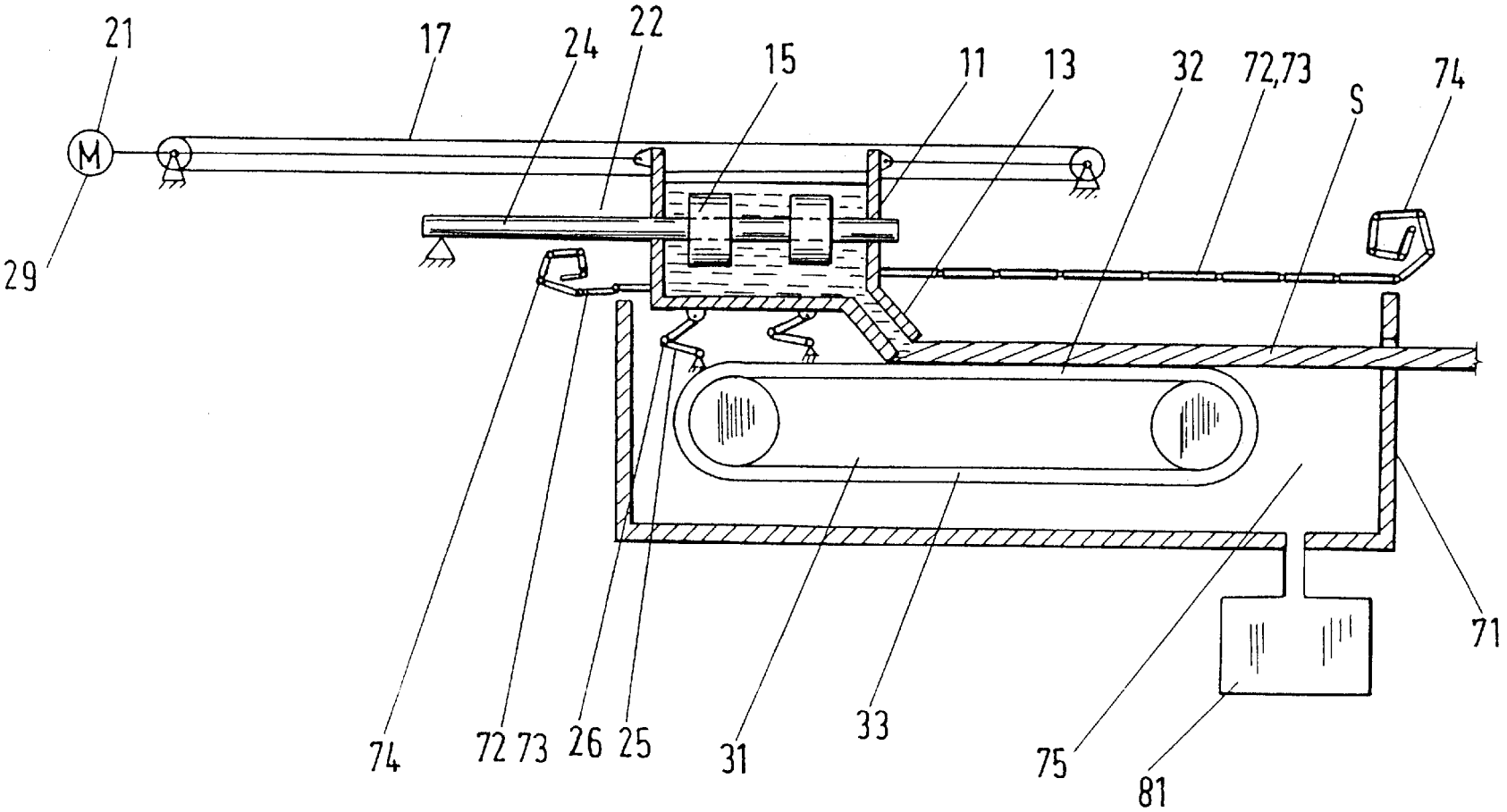
FIG. 3 shows a strip casting device with a housing.

In FIG. 3, the movement elements 22 are designed as sliding elements 15 which are fastened to the material supply vessel 11 and which match with a track 24.

Provided on the material supply vessel 11 are levers 25 having joints 26, by means of which the position of the outlet nozzle 13 in relation to the upper strand 33 of the conveyor belt 31 can be set as desired.

In the present case, the material supply vessel 11 is connected via an endless belt 17 connected to an actuator 21 which is designed here as an electric drive 29.

Furthermore, the billet S is encased by a housing 71 which is connected to a gas supply 81. The housing 71 possesses a cover 72 which, in the present case, is designed as a blind 73. The blind 73 is fastened, gastight, at one end to the material supply vessel 11 and at the other end has winding devices 74. Preferably inert gas is conveyed into the interior 75 of the housing 71 via the gas supply 81.

I claim:

1. A method for casting rectangular billets from metal close to final dimensions and for subsequent inline rolling out of the billet, with a material supply vessel, via an outlet nozzle of which the liquid metal is deposited onto an upper stand of a conveyor belt, on which the metal solidifies and is transferred to a roll stand for forming a rolling stock, the method comprising the steps of:

a) before starting casting, aa) approximating a point at which the liquid metal is deposited onto the conveyor belt, and ab) setting conveying speed of the conveyor belt as a function of a desired rolling thickness and rolling speed of the roll stand; and b) during casting, ba) detecting position of thorough solidification of the metal billet located on the conveyor belt, bb) detecting temperature of the rolling stock in a region of the roll stand, and bc) using the position of thorough solidification and the temperature of the rolling stock as control variables for the current position of a point at which the liquid metal leaving the material supply vessel is deposited onto the conveyor belt.

2. A method as defined in claim 1, including detecting a thickness of the metal billet located on the conveyor belt and using the detected thickness for controlling a quantity flow of the liquid metal leaving the material supply vessel.

3. A method as defined in claim 1, including detecting speed of the conveyor belt and using the detected speed for controlling a quantity flow of the liquid metal leaving the material supply vessel.

4. A method as defined in claim 1, including taking geodetic height of the metal located in the material supply vessel into account when controlling the quantity flow of the liquid metal leaving the material supply vessel.

5. A method as defined in claim 1, including taking a discharge of heat from the metal billet located on the conveyor belt into account when controlling the position of the material depositing point.

6. A device for casting rectangular billets from metal close to final dimensions and for subsequent inline rolling out of the billet, comprising: a metal supply vessel having an outlet nozzle; a horizontally arranged conveyor belt; at least one roll stand downstream of the conveyor belt for forming a rolling stock; movement elements connected to the material supply vessel so as to move the supply vessel in a horizontal direction, coaxially to a major axis of the conveyor belt, in or opposite to a conveying direction of a billet; an actuator connected to the material supply vessel; regulating means for regulating the actuator; first measuring elements connected to the regulating means and operatively arranged for detecting a position of the thorough solidification of the billet; and second measuring elements connected to the regulating means and operatively arranged for detecting temperature of the rolling stock.

7. A device as defined in claim 6, and further comprising means for controlling quantity flow of metal through the outlet nozzle of the metal supply vessel.

8. A device defined in claim 7, wherein the control means includes at least one of a controllable closing element and a vacuum device.

9. A device as defined in claim 6, and further comprising rails, the movement elements being wheels which are connected to the material supply vessel and run on the rails.

10. A device as defined in claim 6, and further comprising a track, the movement elements being sliding elements which are connected to the material supply vessel and match with the track.

11. A device as defined in claim 6, wherein the movement element are levers which have joints and are designed as thrust mechanisms such that, in the event of a horizontal movement of the material supply vessel, a mouth of the outlet nozzle is guided at a constant distance from an upper strand of the conveyor belt over a defined region.

12. A device as defined in claim 6, wherein the movement elements are piston/cylinder units, and further comprising further regulating means connected to the piston/cylinder units for guiding a mouth of the outlet nozzle at a constant distance from an upper strand of the conveyor belt in the event of a horizontal movement of the material supply vessel.

13. A device as defined in claim 6, wherein the actuator is a hydraulic piston/cylinder unit.

14. A device as defined in claim 13, wherein the piston/cylinder unit is a synchronous cylinder, and further comprising a spacer rod arranged to connect the synchronous cylinder to the material supply vessel.

15. A device as defined in claim 6, wherein the actuator includes an electric drive, and an endless belt that connects the electric drive to the material supply vessel.

16. A device as defined in claim 6, and further comprising an additional stand having its own drive for moving coaxially to the major axis of the conveyor belt, the movement elements being arranged on the additional stand.

17. A device as defined in claim 6, wherein the material supply vessel is a vacuum vessel having a charging chamber into which the melt can be introduced.

18. A device as defined in claim 6, and further comprising a housing arranged to encase at least free surfaces of the billet from a depositing point on the conveyor belt and during transport by the conveyor belt.

19. A device as defined in claim 18, wherein the housing has a cover equipped as a blind which is connected at one end to the outlet nozzle of the material supply vessel and allows it to execute an unimpeded traveling movement, and further comprising a winding device connected at an other end of the cover.

20. A device as defined in claim 18, and further comprising gas supply means connected to the housing for supplying gas.

* * * * *